United States Patent [19]

Lavigne, Jr.

[11] 4,142,381

[45] Mar. 6, 1979

[54] FLASH TYPE SUBCOOLER

[75] Inventor: William J. Lavigne, Jr., Fayetteville, N.Y.

[73] Assignee: Carrier Corporation, Syracuse, N.Y.

[21] Appl. No.: 828,446

[22] Filed: Aug. 29, 1977

[51] Int. Cl.[2] ..... F25B 1/10; F25B 1/00

[52] U.S. Cl. ..... 62/510; 62/115; 62/117

[58] Field of Search ..... 62/115, 117, 174, 219, 62/504, 505, 510, 512

[56] References Cited

U.S. PATENT DOCUMENTS

| | | | |
|---|---|---|---|
| 2,274,391 | 2/1942 | Zwickl | 62/117 |
| 2,277,647 | 3/1942 | Jones | 62/510 |
| 3,022,638 | 2/1962 | Caswell et al. | 62/115 |
| 3,553,974 | 1/1971 | Osborne | 62/115 |
| 3,882,689 | 5/1975 | Rogers | 62/115 |

*Primary Examiner*—Lloyd L. King

*Attorney, Agent, or Firm*—J. Raymond Curtin; Robert P. Hayter

[57] ABSTRACT

A subcooler for use in a refrigeration system wherein liquid refrigerant is flashed such that part of the refrigerant changes state from a liquid to a gas absorbing heat from the remaining liquid refrigerant. An economizer condenser is provided in the subcooler such that the flashed refrigerant gas may be recondensed within the subcooler. Liquid refrigerant enters the subcooler through the casing and is flashed through an orifice into a distribution box. The distribution box has perforated end plates such that the flashed gaseous refrigerant is distributed throughout the subcooler to evenly contact the economizer condenser mounted therein. Liquid refrigerant is collected in the bottom of the subcooler and therefrom conducted to the next component of the refrigeration system.

5 Claims, 3 Drawing Figures

FLASH TYPE SUBCOOLER

BACKGROUND OF THE INVENTION

1. Field of the Invention

The present invention relates to refrigeration systems which are adapted to cool a fluid for domestic or other uses. More particularly the present invention relates to refrigeration systems wherein a flash type subcooler is utilized to subcool liquid refrigerant by changing part of the liquid refrigerant to a gas thereby absorbing heat from the remaining liquid refrigerant.

2. Description of the Prior Art

Refrigerant systems of a vapor compression type typically employ a compressor to increase the temperature and pressure of the gaseous refrigerant. Connected thereto is a condenser wherein the gaseous refrigerant is cooled so it changes state to a liquid refrigerant. Thereafter the refrigerant may be subcooled in a flash economizer wherein a part of the refrigerant is vaporized absorbing heat from the remaining liquid refrigerant. The vaporized refrigerant has been typically drawn into the compressor for recycling through the condenser and the liquid refrigerant which has now been cooled passes on to the evaporator or chiller. In the chiller refrigerant is evaporated absorbing heat from the fluid to be cooled, the now gaseous refrigerant being drawn into the compressor to complete the cycle. In the above described refrigeration system the compressor is a multi-stage compressor such that the flashed refrigerant from the flash economizer may be drawn into the compressor between stages allowing the flash economizer to be at an intermediate pressure to the condenser such to the chiller. The basic patent dealing with the flash economizer was issued to Jones in 1942 and is entitled "Refrigeration", U.S. Pat. No. 2,277,647.

Other methods of removing flashed refrigerant gas from a flash economizer have been developed. These include recondensing the flashed gas within the flash economizer or subcooler by the use of an economizer condenser supplied with relatively cool condensing fluid. A combination of an economizer condenser and a compressor may be used such that the flashed refrigerant gas is artially condensed by the economizer condenser and the remainder removed by the compressor. Also flashed refrigerant gas has been removed by a second compressor, said gas is then recondensed by an economizer condenser such that the now liquid refrigerant may be used within the chiller of the refrigeration system. For a better explanation of these various ideas see United States Patent Application entitled "Dual Flash Economizer Refrigeration System", Ser. No. 828,458; "Thermal Economized Refrigeration System", Ser. No. 828,449; "Supply Water Cooling in a Refrigeration System", Ser. No. 828,810; "Thermal Economizer Application for a Centrifugal Refrigeration Machine", Ser. No. 828,448; and "Dual Flash and Thermal Economized Refrigeration System", Ser. No. 828,793, all filed simultaneously herewith and all assigned to the assignee hereof.

The subcooler or flash economizer for use within the above referenced systems normally has an economizer condenser mounted at the top thereof so that rising refrigerant gas may be condensed thereon. A reservoir is provided in the bottom of the subcooler such that a liquid refrigerant may be collected and conducted to the next component in the refrigeration system. A means for flashing the liquid refrigerant into the flash economizer is provided in the middle of the flash economizer such that the flashed gas may rise and a liquid refrigerant may fall to the bottom thereof.

The particular apparatus hereafter described uses a distribution box having perforated end plates to evenly distribute flashed refrigerant gas throughout the economizer condenser. In Zwickl, U.S. Pat. No. 2,274,391, openings are provided in an evaporator for distribution of flashed refrigerant gas. However there is no flow of liquid refrigerant through the openings or through the distribution box but merely a guide path such that gaseous refrigerant is withdrawn by the compressor evenly throughout the evaporator. Furthermore this evaporator is not a subcooler and does not have a condensing coil located such that the gaseous refrigerant will be condensed thereon within that pressure vessel.

The flash economizer or subcooler described herein is adapted to be utilized with a single-stage or multi-stage existing or new refrigeration machine. This flash economizer is particularly adaptable for retrofit machinery to provide a flash economizing step without the addition of an additional compressor. This flash economizer utilizing an economizer condenser with a cool water supply also operates to increase the refrigeration system efficiency and simultaneously may be utilized to preheat building supply water.

SUMMARY OF THE INVENTION

An object of the present invention is to provide apparatus within a refrigeration system for subcooling liquid refrigerant.

Another object of the present invention is to provide a flash type subcooler within a refrigeration system wherein part of a liquid refrigerant is flashed such that it absorbs the heat from the remaining liquid refrigerant.

Another object of the present invention is to provide an economizer condenser within a flash type subcooler such that the flashed gaseous refrigerant is recondensed therein.

A further object of the present invention is to provide a distribution box such that gaseous refrigerant and liquid refrigerant are equally distributed throughout the subcooler.

A further object of the present invention is to completely mix as well as control expansion of the entering refrigerant.

A further object of the present invention is to provide a large surface area for the release of flashed gas.

Another object of the present invention is to provide an arrangement that will easily fit into existing refrigeration machines with a minimum of piping alterations.

Another object of the present invention is to provide a subcooler design which may be utilized in a retrofit market.

Other objects will be apparent from the description to follow and from the appended claims.

The preceding objects are achieved according to a preferred embodiment of the invention by the provision of a distribution box within a cylindrical flash type economizer. The distribution box is located in the middle of the economizer and is connected to an entering liquid refrigerant line such that liquid refrigerant is flashed into the distribution box and the gaseous refrigerant is allowed to flow upward and the liquid refrigerant is collected in the bottom thereof. The distribution box has at either end thereof perforated distribution plates such that the flashed refrigerant gas is evenly distributed throughout the subcooler. Annexed to the distribution box are channel plates provided for conveying a liquid refrigerant away from the distribution box. A float valve is located in the bottom of the flash economizer such that liquid refrigerant is collected therein for piping to the next component of the refrigeration system. An economizer condenser is mounted in the top of the flash economizer and provided with a cooling fluid such that the flashed liquid refrigerant is condensed thereon.

DESCRIPTION OF THE PREFERRED EMBODIMENT

The embodiment of the invention described below is adapted for use in a vapor compression refrigeration system having a compressor, a condenser and an evaporator. It is to be understood that the present invention finds applicability in other types of refrigeration systems other than single-stage vapor compression refrigeration systems and including adsorption and other types of refrigeration cycles. The present invention is further adapted so that multiple condensers within a refrigeration system may be utilized. The multiple condensers may be connected in series or otherwise which would be consistent with the disclosure of the invention herein.

Figure 1:
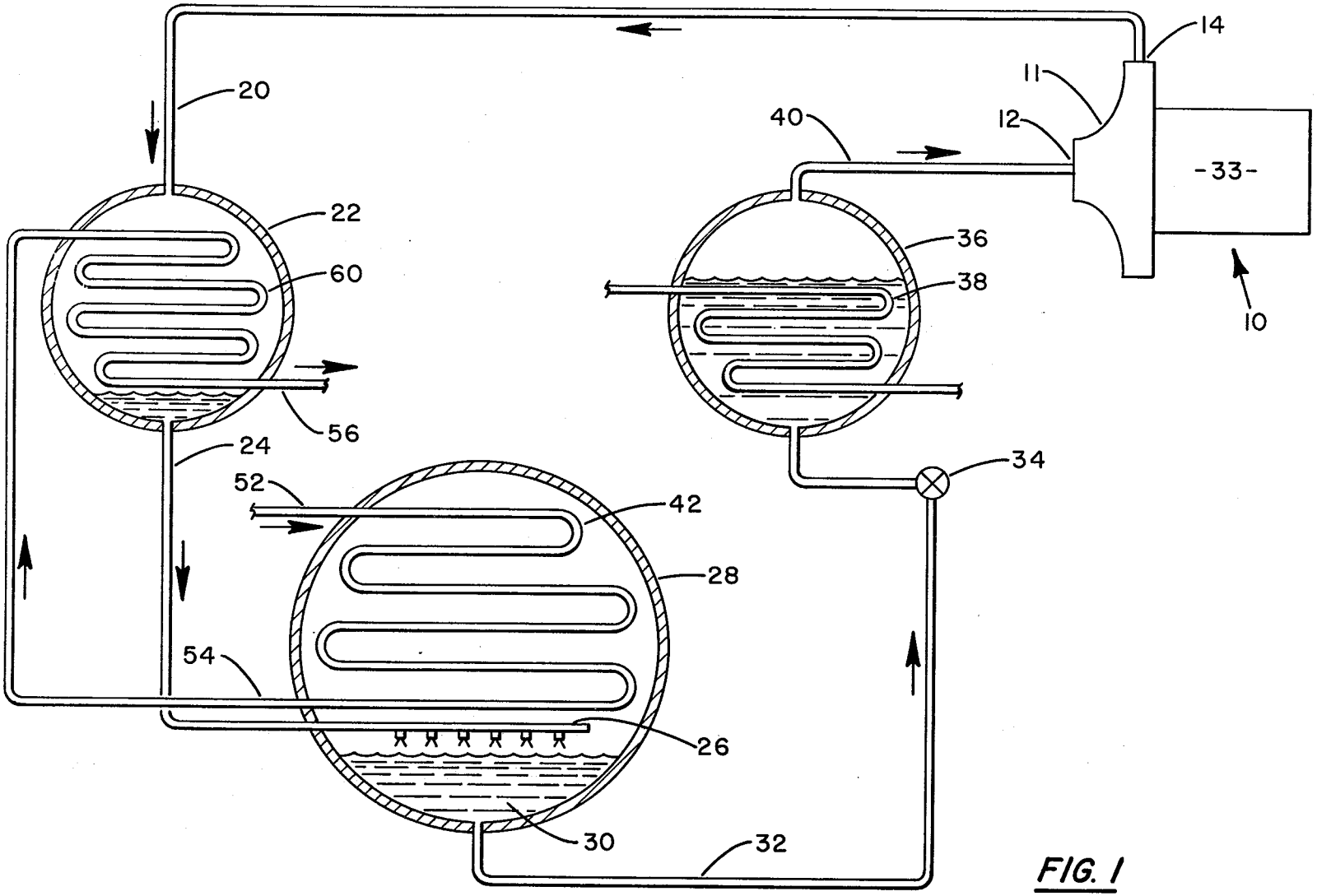
FIG. 1 is schematic diagram of a vapor compression refrigeration system utilizing a thermally economized flash economizer.

Referring to FIG. 1, the schematic diagram of the vapor compression refrigeration system it can be seen that compressor 10 driven by motor 33 provides at outlet 14 gaseous refrigerant at increased temperature and pressure. The compressed refrigerant travels through line 20 to condenser 22 wherein it changes state to a liquid refrigerant. Therefrom the liquid refrigerant is conducted through line 24 to nozzles 26 within flash economizer 28. The liquid refrigerant enters the flash economizer at an increased pressure over the pressure within the flash economizer and consequently part of the liquid refrigerant is flashed changing state from a liquid to a gas absorbing heat from the remaining liquid refrigerant. The liquid refrigerant is then collected in reservoir 30 at the bottom of flash economizer 28 and conducted by line 32 to expansion control device 34. From the expansion control device the refrigerant passes to chiller 36 wherein it changes state from a liquid to a gas absorbing heat from the fluid to be cooled. The gaseous refrigerant is now conducted by line 40 to inlet 12 to compressor 11 and the refrigerant is recompressed to begin the cycle again.

Within the flash economizer 28 is mounted economizer condenser 42. The economizer condenser is the heat exchanger in heat exchange relationship with the flashed gas from nozzles 26 such that the flashed refrigerant may be condensed thereon. This condensed refrigerant is then collected in reservoir 30 with the liquid refrigerant that originally entered the flash economizer. Entering condensing water is supplied through line 52 to the economizer condenser 54 and is discharged through line 54. This entering supply of water may typically be building supply water or other supply water which is colder than the average tower condensing water. The water is then circuited from line 54 through heat exchanger coil 60 in condenser 22 and exits therefrom through line 56. Additional condensing water may be provided for condenser 22 to meet the load thereon. The term city supply water refers to the entering water to be utilized within the enclosure. Typically this is municipal water purchased by the building management for use in the building or well water or some other supply water which is normally provided at a much lower temperature than available tower condensing water.

Figure 2:
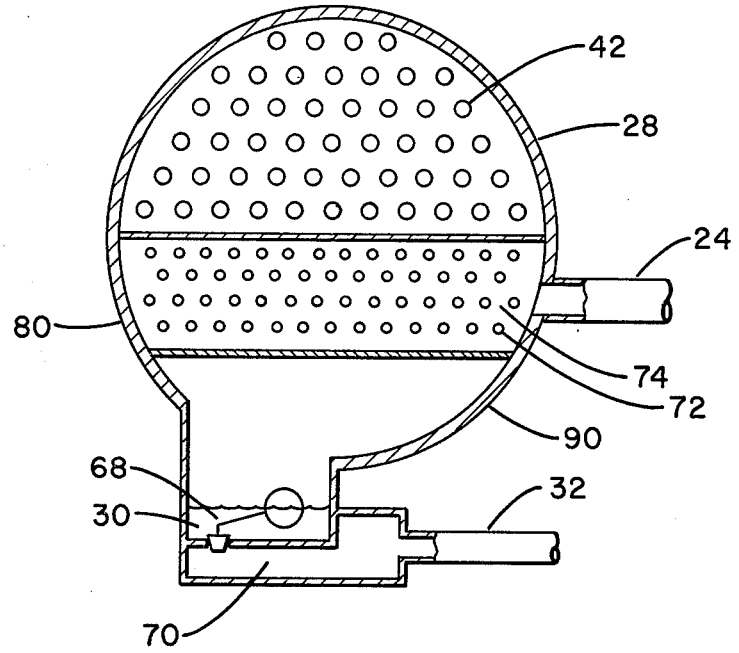
FIG. 2 is a cross-sectional view of the flash economizer taken at line 2—2.
Figure 3:
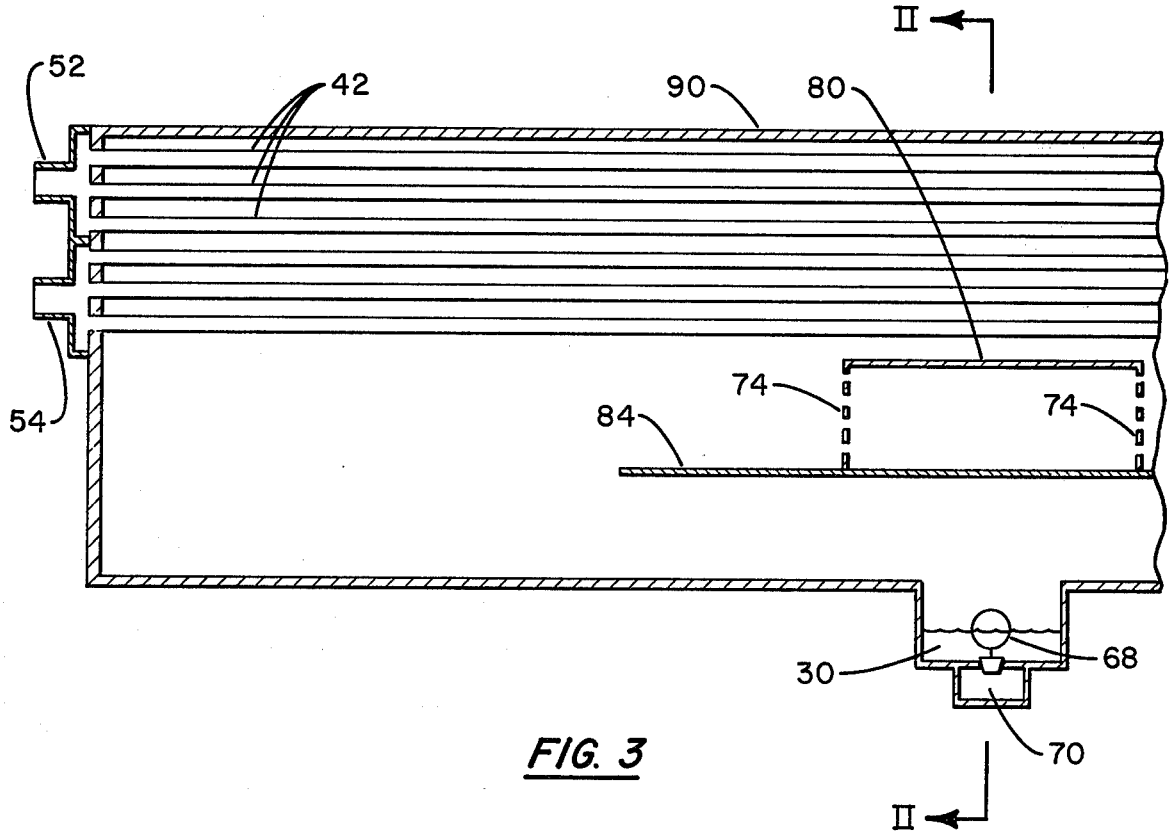
FIG. 3 is an elevational sectional view of the flash economizer.

Referring now to FIG. 2 it can be seen that flash economizer or subcooler 28 has mounted in the top thereof economizer condenser 42. In the middle of the flash economizer is mounted distribution box 80 having a perforated plate 74 with perforations 72 through which flashed refrigerant gas is distributed throughout the subcooler. Liquid refrigerant from condenser 22 enters the distribution box 80 through line 24. Liquid refrigerant is then collected in reservoir 30 at the bottom of casing 90 of the subcooler. When sufficient level of the refrigerant is collected float valve 68 opens and liquid refrigerant travels through collection box 70 to discharge line 32 and then proceeds on to the expansion control device within the refrigeration system. FIG. 3, a sectional view of the subcooler shows economizer condenser 42 mounted at the top of the subcooler and condensing water inlet 52 and condensing water outlet 54 connected thereto. Distribution box 80 is shown mounted in the middle of the subcooler and having an orifice 25 in communication with conduit 24 such that the liquid refrigerant entering subcooler is flashed through the orifice to a decreased pressure area. During this flashing part of the liquid refrigerant changes state to a gaseous refrigerant absorbing heat from the remaining liquid refrigerant. Perforated plates 74 are mounted on either end of distribution box 80 and the flashed refrigerant gas is through them distributed evenly throughout the subcooler. Liquid refrigerant is distributed from the distribution box on channel plates 84 such that it is conveyed away from the distribution box and is exposed to the internal space of the subcooler over a large surface area. This allows for any absorbed refrigerant gas to be released. The liquid refrigerant is then forced by gravity along the inclined bottom of the subcooler so that it may be collected at reservoir 30. In reservoir 30 it can be seen the float valve 68 operates to allow liquid refrigerant to enter collection box 70 and conduit 32. The perforations 72 in the end of each perforation plate 74 are so arranged that the flashed refrigerant gas is evenly distributed about the entire subcooler and consequently contacts the economizer condenser evenly throughout the subcooler. The economizer condenser condenses the flashed refrigerant gas which then drips to the bottom of the subcooler and is collected with the remaining liquid refrigerant.

The distribution box and perforated end plates thereof assure thorough mixing of the refrigerant as it enters the subcooler. By changing the direction of the flow of the refrigerant within the subcooler the kinetic energy of the refrigerant flow is redistributed and the refrigerant is directed in a uniform and moderate horizontal velocity. While the mixture is moving from the distribution box the flashed refrigerant gas is able to separate from the refrigerant mixture over a large surface area of both the distribution box and the channel plates 84. The flashed gas is allowed to rise to interact with the economizer condenser mounted in the top of the subcooler where it is recondensed and falls so that it may be collected with the remaining liquid refrigerant. The liquid refrigerant is collected beneath the distribution box in reservoir 30 and its exit from the flash economizer is controlled by float valve 68. The refrigerant which has now been subcooled is thereafter passed through the expansion control device wherein the pressure is further decreased so that the refrigerant may be evaporated in the chiller to absorb heat from the fluid to be cooled.

The above described preferred embodiment of the invention has shown a convenient and economical apparatus for flashing and distributing refrigerant within a subcooler such that the flashed gaseous refrigerant may be recondensed therein at the same time the liquid refrigerant is subcooled by the flashing process. The subcooled liquid refrigerant and the recondensed liquid refrigerant are then collected and conducted on within the refrigeration system such that the overall efficiency of the refrigeration system is increased by the provision of the subcooled liquid refrigerant.

The invention has been described in detail with particular reference to a preferred embodiment thereof but it will be understood that variations and modifications can be effected within the spirit and scope of the invention and that the invention is applicable in many types of refrigeration systems as well as single-stage vapor compression refrigeration systems.

What is claimed is:

1. A flash subcooler for use in a refrigeration system having a refrigerant which comprises:

a pressurized casing;

a heat exchanger mounted within the casing;

means for supplying the heat exchanger with a cooling fluid;

a distribution box for discharging the refrigerant throughout the casing;

flashing means mounted within the casing for receiving liquid refrigerant and discharging a combination of liquid and gaseous refrigerant within the distribution box;

means for supplying liquid refrigerant to the flashing means; and outlet means for discharging refrigerant from the subcooler whereby part of the liquid refrigerant entering the subcooler is flashed to the gaseous state absorbing heat from the remaining liquid refrigerant, said gaseous refrigerant being recondensed by the heat exchanger and the now cooled combination of liquid refrigerant that entered the subcooler and did not change state with the recondensed liquid refrigerant being discharged from the subcooler.

2. The invention as set forth in claim 1 wherein the heat exchanger is located within the top of the casing, the distribution box is located within the middle of the casing, and the outlet means is located within the bottom of the casing.

3. The invention as set forth in claim 2 wherein the outlet means includes a refrigerant reservoir controlled by a float valve.

4. The invention as set forth in claim 1 wherein the distribution box includes:

perforated end plates for evenly spreading the gaseous refrigerant throughout the casing; and channel plates for conveying the liquid refrigerant away from the distribution box.

5. The invention as set forth in claim 1 wherein the flashing means includes an orifice mounted within the casing, said orifice receiving liquid refrigerant from the means for supplying liquid refrigerant.

* * * * *